US006596669B1

(12) United States Patent
Maruyama et al.

(10) Patent No.: US 6,596,669 B1
(45) Date of Patent: Jul. 22, 2003

(54) REVERSIBLE TWO-COLOR HEAT-SENSITIVE RECORDING MATERIAL AND RECORDING METHOD

(75) Inventors: Jun Maruyama, Tokyo (JP); Hidekazu Sano, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 09/700,593

(22) PCT Filed: Mar. 27, 2000

(86) PCT No.: PCT/JP00/01850

§ 371 (c)(1),
(2), (4) Date: Nov. 15, 2000

(87) PCT Pub. No.: WO00/58108

PCT Pub. Date: May 10, 2000

(30) Foreign Application Priority Data

| | | |
|---|---|---|
| Mar. 25, 1999 | (JP) | 11-080641 |
| Apr. 23, 1999 | (JP) | 11-116745 |
| Sep. 28, 1999 | (JP) | 11-273686 |
| Mar. 10, 2000 | (JP) | 2000-066145 |

(51) Int. Cl.[7] ..... B41M 5/30
(52) U.S. Cl. ..... 503/204; 503/201; 503/216
(58) Field of Search ..... 503/201, 200, 503/226

(56) References Cited

U.S. PATENT DOCUMENTS

| | | | | |
|---|---|---|---|---|
| 5,498,772 A | * | 3/1996 | Maruyama et al. | 503/216 |
| 5,534,907 A | | 7/1996 | Tsutsui et al. | 347/175 |
| 6,184,180 B1 | * | 2/2001 | Maruyama et al. | 503/216 |

FOREIGN PATENT DOCUMENTS

| | | |
|---|---|---|
| JP | 6-79970 | 3/1994 |
| JP | 6-286313 | 10/1994 |
| JP | 6-305247 | 11/1994 |
| JP | 7-17132 | 1/1995 |
| JP | 7-68934 | 3/1995 |
| JP | 7-156540 | 6/1995 |
| JP | 7-179043 | 7/1995 |
| JP | 7-214902 | 8/1995 |
| JP | 10-217610 | 8/1998 |

* cited by examiner

*Primary Examiner*—B. Hamilton Hess
(74) *Attorney, Agent, or Firm*—Paul E. White, Jr.; Manelli Denison & Selter PLLC

(57) ABSTRACT

The present invention is to provide a reversible two-color heat-sensitive recording material which uses an electron-donative dye precursor which is usually colorless or a pale color and an electron-accepting compound, and a reversible heat-sensitive color-forming composition which is capable of forming a color-formation state and decolorization state relatively due to difference in heating temperature and/or cooling rate after heating is formed on a support, wherein the reversible heat-sensitive color-forming composition comprises at least two kinds of compositions having different color tones to be formed and the compositions are each present separately and in an independent state, and crystallization rates of the electron-donative compounds at the time of changing from the color-formation state to the decolorization state are different from each other.

16 Claims, 2 Drawing Sheets

REVERSIBLE TWO-COLOR HEAT-SENSITIVE RECORDING MATERIAL AND RECORDING METHOD

BACKGROUND OF THE INVENTION

1. Field of the Invention

This invention relates to reversible two-color heat-sensitive recording materials in which formation of images and decolorization of the images can be carried out by controlling the heat energy. Moreover, the present invention relates to a recording method of the above-mentioned recording materials.

2. Prior Art

Heat-sensitive recording materials generally comprise a support and, provided thereon, a heat-sensitive recording layer mainly composed of a normally electron donating colorless or slightly colored dye precursor (hereinafter sometimes also referred to as "leuco dye") and an electron accepting compound (hereinafter sometimes also referred to as "a color developer") The dye precursor and the color developer instantaneously react upon application of heat by thermal head, thermal pen, laser beams or the like to form an image. Such heat-sensitive recording materials are disclosed in Japanese Patent Application Kokoku Nos. 43-4160, 45-14039 and the like.

In general, in the case of these heat-sensitive materials, when an image is once formed, it is impossible to erase the image and to restore the portion to the original state before forming the image. Therefore, for further recording of information, it is possible to make recording only in the portions where no image is formed. Accordingly, there is a problem that an area for heat-sensitive recording is limited and information to be recorded is restricted and not all of the necessary information can be recorded.

In recent years, reversible heat-sensitive recording materials capable of forming images and decolorizing the same repeatedly have been proposed for solving the above problems. For example, Japanese Patent Application Kokai Nos. 54-119377, 63-39377 and 63-41186 disclose heat-sensitive recording materials constituted by a matrix resin and an organic low molecular weight material dispersed in the matrix resin. However, in these methods, transparency of the heat-sensitive recording materials is reversibly changed and so the contrast between the image formed portion and the image unformed portion is insufficient.

Also, in the methods described in Japanese Patent Application Kokai Nos. 50-81157 and 50-105555, an image to be formed changes depending on the environmental temperatures, so that a temperature to maintain the image-formed state and a temperature to maintain the image-erased state are different from each other. Thus, these two states cannot be maintained for an optional period of time under normal temperature.

Further, Japanese Patent Application Kokai No. 59-120492 discloses a method for maintaining the image-formed state and the image-erased state by keeping the recording material in the region of the hysteresis temperatures utilizing the hysteresis characteristics of color forming components. However, this method requires a heat source and a cooling source for image formation and erasing the same and has the defects that the temperature region at which the image-formed state and the image-erased state can be maintained is limited to the region of the hysteresis temperature. Thus, this method is still not sufficient for using the materials in the temperature and environment of everyday life.

On the other hand, Japanese Patent Application Kokai Nos. 2-188293 and 2-188294 and International Patent Publication No. WO90/11898 disclose reversible heat-sensitive recording media comprising a leuco dye and a color developing and decolorizing agent which causes color formation of the leuco dye upon heating and causes decolorization of the color (or erases a formed color). The color developing and decolorizing agent is an amphoteric compound having an acidic group which causes color formation of the leuco dye and a basic group which causes decolorization of the leuco dye. It preferentially causes one of the color formation action of the acidic group and the decolorization action of the basic group by controlling the heat energy, thereby to perform the color formation and decolorization. However, according to this method, it is impossible to completely change the color forming reaction and the decolorizing reaction to each other only by controlling heat energy. Also, both of the reactions simultaneously take place with a certain ratio so that a sufficient color density cannot be obtained and the decolorization cannot be completely performed. For this reason, a sufficiently high contrast of the image cannot be obtained. Moreover, the decolorizing action of the basic group acts also on the color formed portion at room temperature, so that the density of the color formed portion inevitably decreases with a lapse of time. Furthermore, in Japanese Patent Application Kokai No. 5-124360, reversible heat-sensitive recording media which can form a color and erase the same by heating a leuco dye is described. Also, as an electron-accepting compound, there are exemplified by an organic phosphoric acid compound, α-hydroxyaliphatic carboxylic acid, aliphatic dicarboxylic acid and a specific phenol compound such as an alkylthiophenol, an alkyloxyphenol, an alkylcarbamoylphenol and alkyl gallate each having a carbon number of 12 or more, etc. However, in this recording media, coloring density is low or decolorization of images is incomplete so that the two problems cannot be solved simultaneously and image stability with a lapse of time is also not practically satisfied.

The present applicants have previously proposed in Japanese Patent Application Kokai Nos. 7-108761, 7-179043 and 7-214907, etc., that a phenol compound having a specific connecting group as an electron-accepting compound is excellent in color-formation and decolorization contrast, image stability with a lapse of time and high speed decolorization properties.

On the other hand, there are great demands for a multi-color heat-sensitive recording, and a two-color heat-sensitive recording material has recently been in the region of practical use. This two-color heat-sensitive recording material comprises compositions having different color tones being laminated on a support and employs a method of forming respective images with low temperature energy and high temperature energy. More specifically, it has been accomplished by the two kinds of methods of a color mixing type wherein a high temperature color-formed image is added to a low temperature color-formed image, and a decolorization type wherein a low temperature color-formed image is erased by using a suitable erasing agent as soon as a high temperature color-formed image is obtained. However, in a color addition type, two-color image with good contrast can only be obtained as long as the high temperature color-formed image has a color tone which can sufficiently conceal the low temperature color-formed image. Also, in the decolorization type, a combination of color tones to be color-formed is free but there are problems in the points of color-formation and decolorization contrast, stability of the image with a lapse of time, or the like.

Recently, a method of utilizing a reversible heat-sensitive color-forming composition for an approach to a multi-color heat-sensitive recording material has been proposed. According to Japanese Patent Application Kokai Nos. 6-79970 and 6-305247, there are disclosed a material in which two or more kinds of reversible heat-sensitive color-forming compositions different in decolorization initiating temperatures are provided, and after forming all the mixed colors, a part of the image is erased at a suitable temperature to obtain an optional mixed color or a single color image. However, in this recording medium, differentiation of the decolorization initiating temperatures is carried out based on the length of an alkyl group possessed by an electron-accepting compound. Thus, there is a problem in a color-formation and decolorization contrast of a low temperature decolorizing layer containing a compound having a short alkyl group, or in stability of an image with a lapse of time. Also, its image forming system is a two step system of whole color formation and partial decolorization. Thus, a heating time required for partial decolorization is extremely long so that there is a problem in the point of high-speed processing and many inconvenient points for practical use remain in this system.

As mentioned above, there are large desires to the multi-color heat-sensitive recording and earnest studies have been carried out, but it is the present status that a material which satisfies practical requirements has not yet been found out.

Accordingly, an object of the present invention is to provide a reversible two-color heat-sensitive recording material having stable color-formation and decolorization contrast, having an image stability which causes no problem for practical use in everyday life, and further it is capable of effecting high-speed printing and erasion of the same, and an image recording method thereof.

DISCLOSURE OF THE INVENTION

The present inventors have studied to solve the problems, and as a result, they have found that, in a reversible two-color heat-sensitive recording material containing a plural number of reversible heat-sensitive color forming compositions using a dye precursor which is usually colorless or a pale color and an electron-accepting compound on a support, by controlling crystallization rates of the electron-accepting compounds by temperatures, it is possible to form colors only by optional combination of color-forming compositions to accomplish the present invention.

That is, according to the present invention, a reversible two-color heat-sensitive recording material can be provided that, in a reversible two-color heat-sensitive recording material which uses an electron-donative dye precursor which is usually colorless or a pale color and an electron-accepting compound, and a reversible heat-sensitive color-forming composition which is capable of forming a color-formation state and decolorization state relatively due to difference in heating temperature and/or cooling rate after heating is formed on a support, said reversible heat-sensitive color-forming composition comprises at least two kinds of compositions having different color tones to be formed and said compositions are each present separately and in an independent state, and crystallization rates of said electron-accepting compounds at the time of changing from the color-formation state to the decolorization state are different from each other.

Also, according to the present invention, a reversible two-color heat-sensitive recording material can be provided which is characterized in that, when the above-mentioned reversible heat-sensitive color-forming composition is heated, melted and rapidly cooled to form a mixture in a color-formed state, said color-forming mixture can be formed at different temperatures.

Moreover, these reversible two-color heat-sensitive recording materials can be provided by a recording method which comprises effecting a first printing of the reversible two-color heat-sensitive recording material in which a reversible heat-sensitive color-forming composition is provided on a support at the state of heating the material at a temperature capable of obtaining a cooling rate at which said composition having a higher color-formation temperature forms a color-formation state and said composition having a lower color-formation temperature can form a decolorization state; effecting a second printing at the state of a temperature at which said composition having a higher color-formation temperature does not form the color-formation state and said composition having a lower color-formation temperature can form a color-formation state; and effecting decolorization at a temperature capable of obtaining a cooling rate at which all of said compositions in the color-formation states can form decolorization states.

BEST MODE FOR CARRYING OUT THE INVENTION

Figure 1:
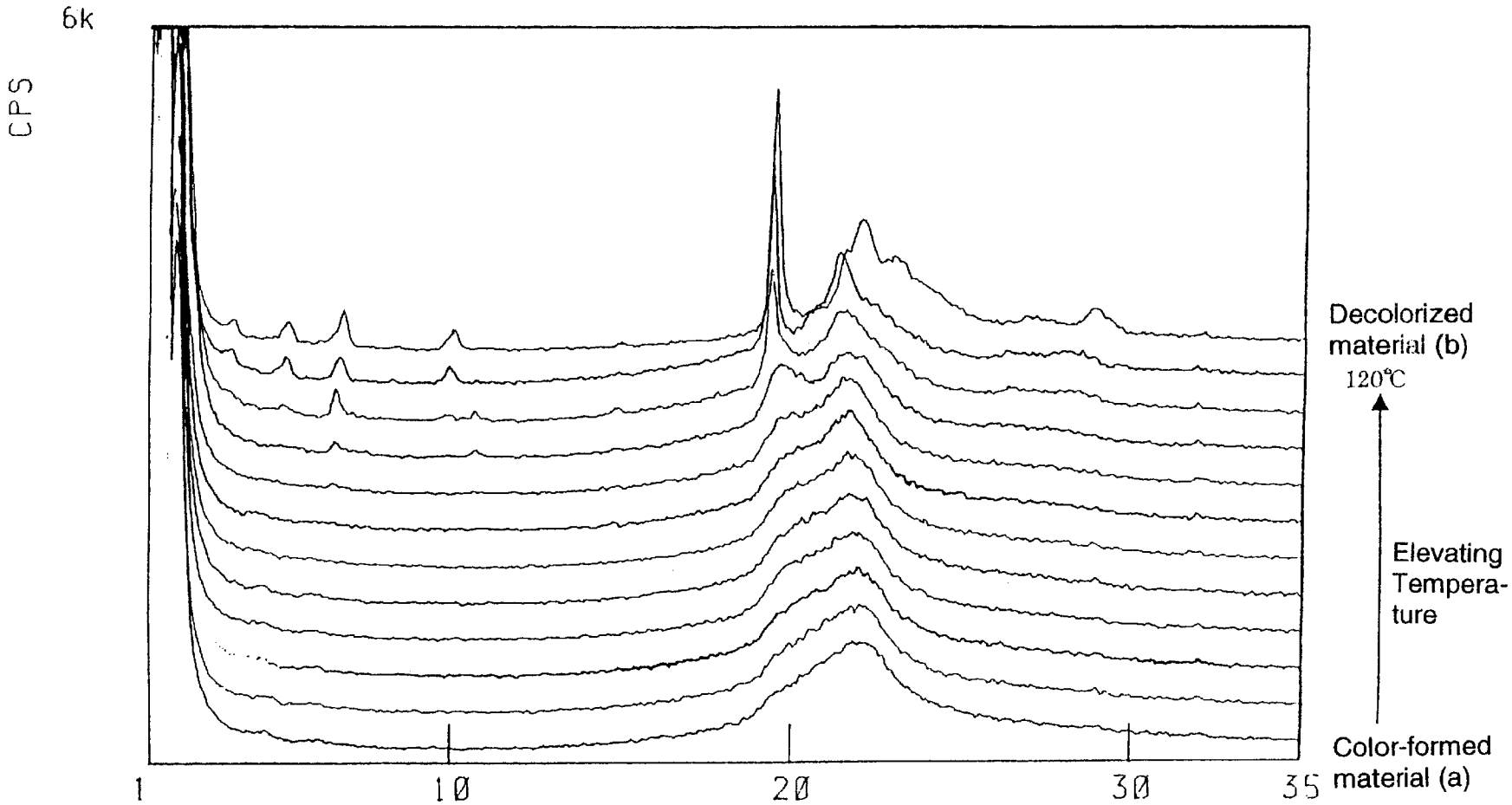
FIG. 1 is an X-ray diffraction spectrum of a color forming composition (S composition) having a slow crystallization rate to be used in the present invention.

In the following, the present invention is explained in more detail.

The reversible two-colored heat-sensitive recording materials of the present invention comprise a support and a layer comprising a reversible heat-sensitive color-forming composition provided thereon, and the reversible heat-sensitive color-forming composition layer contains an electron-donative dye precursor and an electron-accepting compound which are colorless or pale colored in an environmental temperature of an everyday life and is capable of forming a color-formation state and a decolorization state in a relative manner due to the difference in heating temperatures and/or cooling rates after heating. Also, said reversible heat-sensitive color-forming composition comprises at least two compositions different in formed color tones to each other, which are present in the reversible heat-sensitive color-forming composition layer in a separated or independent state, and crystallization rates of said electron-accepting compounds at the time of changing from the color-formation state to the decolorization state are different from each other.

Also, the recording method of the present invention makes possible the reversible two-color heat-sensitive recording material in which a reversible heat-sensitive color-forming composition is provided on a support (1) to effect a first printing at the state of heating the material at a temperature which gives a cooling rate at which said composition having a higher color-formation temperature forms a color-formation state and said composition having a lower color-formation temperature can form a decolorization state, (2) to effect a second printing at the state of a temperature at which said composition having a higher color-formation temperature does not form the color-formation state and said composition having a lower color-formation temperature can form a color-formation state, and (3) to effect decolorization at a temperature capable of obtaining a cooling rate at which all of said compositions in the color-formation states can be changed to the decolorization states.

In the reversible heat-sensitive color forming composition of the present invention, it is preferred to use a compound represented by the following formulae (1), (2), or (3) as one of the electron-accepting compounds, or a combination of the compounds of the formulae (1) and (2) or a combination of the compounds of the formulae (1) and (3):

(1)

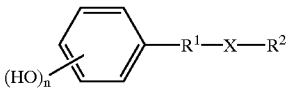

wherein n is an integer of 1 to 3, $R^1$ represents a divalent hydrocarbon group having 1 to 18 carbon atoms, X represents a divalent group having at least one —CONH— bond, and $R^2$ represents a hydrocarbon group having 1 to 24 carbon atoms.

(2)

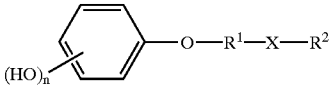

wherein n, $R^1$, $R^2$ and X have the same meanings as defined above.

(3)

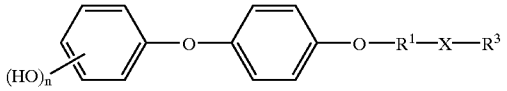

wherein n, $R^1$ and X have the same meanings as defined above, and $R^3$ represents a hydrocarbon group having 1 to 24 carbon atoms which may have an oxygen atom or a sulfur atom.

In the compound represented by the formula (1), n is an integer of 1 or more and 3 or less, $R^1$ represents a divalent hydrocarbon group having 1 to 18 carbon atoms, X represents a divalent group having at least one —CONH— bond, and $R^2$ represents a hydrocarbon group having 1 to 24 carbon atoms.

In the compound represented by the formula (2), $R^1$ represents a divalent hydrocarbon group having 1 to 18 carbon atoms, preferably a divalent hydrocarbon group having 1 to 12 carbon atoms. $R^2$ represents a hydrocarbon group having 1 to 24 carbon atoms, preferably a hydrocarbon group having 6 to 22 carbon atoms. Particularly in $R^3$ of the compound represented by the formula (3), when it has an oxygen atom, or a sulfur atom in the chain, a number of the atom to be contained is preferably 1. Moreover, it is particularly preferred the case where the sum of the carbon number of $R^1$ and $R^2$ in the compounds of the formulae (1) and (2) or the sum of the carbon number of $R^1$ and $R^3$ in the compound of the formula (3) is 11 or more and 35 or less. $R^1$ to $R^3$ each specifically represent mainly an alkylene group and an alkyl group, but an aromatic ring may be contained in the respective groups, and in particular, in the case of $R^1$, it may be an aromatic ring alone.

On the other hand, X in the formulae represents a divalent group having at least one —CONH— bond, and specific examples thereof may include an amide (—CONH—, —NHCO—), urea (—NHCONH—), urethane (—NHCOO—, —OCONH—), diacylamine (—CONHCO—), diacylhydrazide (—CONHNHCO—), oxalic acid diamide (—NHCO—CONH—), acyl urea (—CONHCONH—, —NHCONHCO—), 3-acylcarbazinic acid ester (—CONHNHCOO—), semicarbazide (—NHCONHNH—, —NHNHCONH—), acylsemicarbazide (—CONHNHCONH—, —NHCONHNHCO—), diacylaminomethane (—$CONHCH_2NHCO$—), 1-acylamino-1-ureido-methane (—$CONHCH_2NHCONH$—, —$NHCONHCH_2NHCO$—), malonamide (—$NHCOCH_2CONH$—) and the like.

As specific examples of the electron-accepting compounds represented by the formulae (1) to (3) to be preferably used in one of the present invention, there are those as mentioned below, but the present invention is not limited by these. Incidentally, specific synthetic methods of the compounds are disclosed in Japanese Patent Application Kokai Nos. 7-179043, 11-69787, 11-227314, etc.

Specific examples of the compounds represented by the formula (1) may include N-n-dodecyl-2-(p-hydroxyphenyl)-acetamide, N-n-octadecyl-2-(p-hydroxyphenyl)acetamide, N-n-decyl-3-(p-hydroxyphenyl)propanamide, N-n-octadecyl-3-(p-hydroxyphenyl)propanamide, N-n-octadecyl-6-(p-hydroxyphenyl)hexanamide, N-n-decyl-11-(p-hydroxyphenyl)undecanamide, N-(p-n-octylphenyl)-6-(p-hydroxyphenyl)hexanamide, N-n-octadecyl-p-(p-hydroxyphenyl)benzamide, N-(p-hydroxyphenyl)methyl-n-dodecanamide, N-(p-hydroxyphenyl)methyl-n-octadecanamide, N-[2-(p-hydroxyphenyl)ethyl]-n-octadecanamide, N-[6-(p-hydroxyphenyl)hexyl]-n-decanamide, N-[p-(p-hydroxyphenyl)phenyl]-n-octadecanamide, N-[2-(p-hydroxyphenyl)ethyl]-N'-n-tetradecylurea, N-[2-(p-hydroxyphenyl)ethyl]-N'-n-octadecylurea, N-[2-(3,4-dihydroxyphenyl)ethyl]-N'-n-octadecylurea, N-[6-(p-hydroxyphenyl)hexyl]-N'-n-decylurea, N-[p-(p-hydroxyphenyl)phenyl]-N'-n-octadecylurea, N-[10-(p-hydroxyphenyl)decyl]-N'-n-decylurea, n-octadecyl N-[2-(p-hydroxyphenyl)ethyl]carbamate, n-tetradecyl N-[6-(p-hydroxyphenyl)hexyl]carbamate, n-dodecyl N-[p-(p-hydroxyphenyl)phenyl]carbamate, [2-(p-hydroxyphenyl)ethyl]N-n-octadecylcarbamate, [11-(p-hydroxyphenyl)undecyl]N-n-decylcarbamate, [p-(p-hydroxyphenyl)phenyl]N-n-tetradecylcarbamate, N-[3-(p-hydroxyphenyl)propionyl]-N-n-octadecanoylamine, N-[6-(p-hydroxyphenyl)hexanoyl]-N-n-octadecanoylamine, N-[3-(p-hydroxyphenyl)propionyl]-N-(p-n-octylbenzoyl)amine, N-[2-(p-hydroxyphenyl)aceto]-N'-n-dodecanohydrazide, N-[2-(p-hydroxyphenyl)aceto]-N'-n-octadecanohydrazide, N-[3-(p-hydroxyphenyl)propiono]-N'-n-octadecanohydrazide, N-[3-(3,4-dihydroxyphenyl)propiono]-N'-n-octadecanohydrazide, N-[6-(p-hydroxyphenyl)hexano]-N'-n-tetradecanohydrazide, N-[6-(p-hydroxyphenyl)hexano]-N'-n-octadecanohydrazide, N-[6-(p-hydroxyphenyl)hexano]-N'-(p-n-octylbenzo)hydrazide, N-[11-(p-hydroxyphenyl)undecano]-N'-n-dodecanohydrazide, N-[11-(p-hydroxyphenyl)undecano]-N'-n-tetradecanohydrazide, N-[11-(p-hydroxyphenyl)undecano]-N'-n-octadecanohydrazide, N-[11-(p-hydroxyphenyl)undecano]-N'-(6-phenyl)hexanohydrazide, N-[11-(3,4,5-trihydroxyphenyl)undecano]-N'-n-octadecanohydrazide, N-[p-(p-hydroxyphenyl)benzo]-N'-n-octadecanohydrazide, N-[p-(p-hydroxyphenylmethyl)benzo]-N'-n-octadecanohydrazide, N-[2-(p-hydroxyphenyl)ethyl]-N'-n-tetradecyloxamide, N-[3-(p-hydroxyphenyl)propyl]-N'-n-octadecyloxamide, N-[3-(3,4-dihydroxyphenyl)propyl]-N'-n-octadecyloxamide, N-[11-(p-hydroxyphenyl)undecyl]-N'-n-decyloxamide, N-[p-(p-hydroxyphenyl)phenyl]-N'-n-octadecyloxamide, N-[2-(p-hydroxyphenyl)acetyl]-N'-n-dodecylurea, N-[2-(p-hydroxyphenyl)acetyl]-N'-n-octadecylurea, N-[3-(p-hydroxyphenyl)propionyl]-N'-n-octadecylurea, N-[p-(p-hydroxyphenyl)benzoyl]-N'-n-octadecylurea, N-[2-(p-hydroxyphenyl)ethyl]-N'-n-dodecanoylurea, N-[2-(p-hydroxyphenyl)ethyl]-N'-n-octadecanoylurea, N-[p-(p-hydroxyphenyl)phenyl]-N'-n-octadecanoylurea, n-octadecyl 3-[3-(p-hydroxyphenyl)propionyl]-carbazinate, n-decyl 3-[11-(p-hydroxyphenyl)undecanoyl]-carbazinate, 4-[2-(p-hydroxyphenyl)ethyl]-1-n-tetradecylsemicarbazide, 4-[2-(p-hydroxyphenyl)ethyl]-1-n-octadecylsemicarbazide, 4-[p-(p-hydroxyphenyl)phenyl]-1-n-tetradecylsemicarbazide, 1-[2-(p-hydroxyphenyl)ethyl]-4-n-tetradecylsemicarbazide, 1-[2-(p-hydroxyphenyl)ethyl]-4-n-octadecylsemicarbazide, 1-[p-(p-hydroxyphenyl)phenyl]-4-n-tetradecylsemicarbazide, 1-[2-(p-hydroxyphenyl)acetyl]-4-n-tetradecylsemicarbazide, 1-[3-(p-hydroxyphenyl)propionyl]-4-n-octadecylsemicarbazide, 1-[11-(p-hydroxyphenyl)undecanoyl]-4-n-decylsemicarbazide, 1-[p-(p-hydroxyphenyl)benzoyl]-4-n-octadecylsemicarbazide, 4-[2-(p-hydroxyphenyl)ethyl]-1-n-tetradecanoylsemicarbazide, 4-[2-(p-hydroxyphenyl)ethyl]-1-n-octadecanoylsemicarbazide, 4-[p-(p-hydroxyphenyl)phenyl]-1-n-octadecanoylsemicarbazide, 1-[2-(p-hydroxyphenyl)acetamido]-1-n-dodecanoylaminomethane, 1-[2-(p-hydroxyphenyl)acetamido]-1-n-octadecanoylaminomethane, 1-[3-(p-hydroxyphenyl)propanamido]-1-n-octadecanoylaminomethane, 1-[11-(p-hydroxyphenyl)undecanamido]-1-n-decanoylaminomethane, 1-[p-(p-hydroxyphenyl)benzamido]-1-n-octadecanoylaminomethane, 1-[2-(p-hydroxyphenyl)acetamido]-1-(N'-n-dodecylureido)methane, 1-[2-(p-hydroxyphenyl)acetamido]-1-(N'-n-octadecylureido)methane, 1-[3-(p-hydroxyphenyl)propan-amido]-1-(N'-n-octadecylureido)methane, 1-[11-(p-hydroxyphenyl)undecanamido]-1-(N'-n-decylureido)methane, 1-[p-(p-hydroxyphenyl)benzamido]-1-(N'-n-octadecylureido)methane, 1-{N'-[2-(p-hydroxyphenyl)ethyl]ureido}-1-n-octadecanoylaminomethane, 1-{N'-[p-(p-hydroxyphenyl)phenyl]ureido}-1-n-octadecanoylaminomethane, N-[2-(p-hydroxyphenyl)ethyl]-N'-n-octadecylmalonamide, N-[p-(p-hydroxyphenyl)phenyl]-N'-n-octadecylmalonamide, etc.

Next, specific examples of the compound represented by the formula (2) may include N-n-dodecyl-2-(p-hydroxyphenoxy)acetamide, N-n-octadecyl-2-(p-hydroxyphenoxy)acetamide, N-n-decyl-3-(p-hydroxyphenoxy)propanamide, N-n-octadecyl-3-(p-hydroxyphenoxy)propanamide, N-n-octadecyl-6-(p-hydroxyphenoxy)hexanamide, N-n-decyl-11-(p-hydroxyphenoxy)undecanamide, N-(p-n-octylphenyl)-6-(p-hydroxyphenoxy)hexanamide, N-n-octadecyl-p-(p-hydroxyphenoxy)benzamide, N-(p-hydroxyphenyl)methyl-10-undecenamide, N-(p-hydroxyphenoxy)methyl-n-octadecanamide, N-[2-(p-hydroxyphenoxy)ethyl]-n-octadecanamide, N-[6-(p-hydroxyphenoxy)hexyl]-10-undecenamide, N-[p-(p-hydroxyphenoxy)phenyl]-n-octadecanamide, N-[2-(p-hydroxyphenoxy)ethyl]-N'-n-tetradecylurea, N-[2-(p-hydroxyphenoxy)ethyl]-N'-n-octadecylurea, N-[2-(3,4-dihydroxyphenoxy)ethyl]-N'-n-octadecylurea, N-[6-(p-hydroxyphenoxy)hexyl]-N'-n-decylurea, N-[p-(p-hydroxyphenoxy)phenyl]-N'-n-octadecylurea, N-[10-(p-hydroxyphenoxy)decyl]-N'-n-decylurea, n-octadecyl N-[2-(p-hydroxyphenoxy)ethyl]carbamate, n-tetradecyl N-[6-(p-hydroxyphenoxy)hexyl]carbamate, n-dodecyl N-[p-(p-hydroxyphenoxy)phenyl]carbamate, [2-(p-hydroxyphenoxy)ethyl]N-n-octadecylcarbamate, [11-(p-hydroxyphenoxy)undecyl]N-n-decylcarbamate, [p-(p-hydroxyphenoxy)phenyl]N-n-tetradecylcarbamate, N-[3-(p-hydroxyphenoxy)propionyl]-N-n-octadecanoylamine, N-[6-(p-hydroxyphenoxy)hexanoyl]-N-n-octadecanoylamine, N-[3-(p-hydroxyphenoxy)propionyl]-N-(p-n-octylbenzoyl)amine, N-[2-(p-hydroxyphenoxy)aceto]-N'-n-dodecanohydrazide, N-[2-(p-hydroxyphenoxy)aceto]-N'-n-octadecanohydrazide, N-[3-(p-hydroxyphenoxy)propiono]-N'-n-octadecanohydrazide, N-[3-(3,4-dihydroxyphenoxy)propiono]-N'-n-octadecanohydrazide, N-[6-(p-hydroxyphenoxy)hexano]-N'-n-tetradecanohydrazide, N-[6-(p-hydroxyphenoxy)hexano]-N'-n-octadecanohydrazide, N-[6-(p-hydroxyphenoxy)hexano]-N'-(p-n-octylbenzo)hydrazide, N-[11-(p-hydroxyphenoxy)undecano]-N'-n-decanohydrazide, N-[11-(p-hydroxyphenoxy)undecano]-N'-10-undecenoylhydrazide, N-[11-(p-hydroxyphenoxy)undecano]-N'-n-tetradecanohydrazide, N-[11-(p-hydroxyphenoxy)undecano]-N'-n-octadecanohydrazide, N-[11-(p-hydroxyphenoxy)undecano]-N'-(6-phenyl)hexanohydrazide, N-[11-(3,4,5-trihydroxyphenoxy)undecano]-N'-n-octadecanohydrazide, N-[p-(p-hydroxyphenoxy)benzo]-N'-n-octadecanohydrazide, N-[p-(p-hydroxyphenoxymethyl)benzo]-N'-n-octadecanohydrazide, N-[2-(p-hydroxyphenoxy)ethyl]-N'-n-tetradecyloxaimide, N-[3-(p-hydroxyphenoxy)propyl]-N'-n-octadecyloxamide, N-[3-(3,4-dihydroxyphenoxy)propyl]-N'-n-octadecyloxamide, N-[11-(p-hydroxyphenoxy)undecyl]-N'-n-decyloxamide, N-[p-(p-hydroxyphenoxy)phenyl]-N'-n-octadecyloxamide, N-[2-(p-hydroxyphenoxy)acetyl]-N'-n-dodecylurea, N-[2-(p-hydroxyphenoxy)acetyl]-N'-n-octadecylurea, N-[3-(p-hydroxyphenoxy)propionyl]-N'-n-octadecylurea, N-[p-(p-hydroxyphenoxy)benzoyl]-N'-n-octadecylurea, N-[2-(p-hydroxyphenoxy)ethyl]-N'-n-dodecanoylurea, N-[2-(p-hydroxyphenoxy)ethyl]-N'-n-octadecanoylurea, N-[p-(p-hydroxyphenoxy)phenyl]-N'-n-octadecanoylurea, n-octadecyl 3-[3-(p-hydroxyphenoxy)propionyl]-carbazinate, n-decyl 3-[11-(p-hydroxyphenoxy)undecanoyl]-carbazinate, 4-[2-(p-hydroxyphenoxy)ethyl]-1-n-tetradecylsemicarbazide, 4-[2-(p-hydroxyphenoxy)ethyl]-1-n-octadecylsemicarbazide, 4-[p-(p-hydroxyphenoxy)phenyl]-1-n-tetradecylsemicarbazide, 1-[2-(p-hydroxyphenoxy)ethyl]-4-n-tetradecylsemicarbazide, 1-[2-(p-hydroxyphenoxy)ethyl]-4-n-octadecylsemicarbazide, 1-[p-(p-hydroxyphenoxy)phenyl]-4-n-tetradecylsemicarbazide, 1-[2-(p-hydroxyphenoxy)acetyl]-4-n-tetradecylsemicarbazide, 1-[3-(p-hydroxyphenoxy)propionyl]-4-n-octadecylsemicarbazide, 1-[11-(p-hydroxyphenoxy)undecanoyl]-4-n-decylsemicarbazide, 1-[p-(p-hydroxyphenyl)benzoyl]-4-n-octadecylsemicarbazide, 4-[2-(p-hydroxyphenoxy)ethyl]-1-n-tetradecanoylsemicarbazide, 4-[2-(p-hydroxyphenoxy)ethyl]-1-n-octadecanoylsemicarbazide, 4-[p-(p-hydroxyphenoxy)phenyl]-1-n-octadecanoylsemicarbazide, 1-[2-(p-hydroxyphenoxy)acetamido]-1-n-dodecanoylaminomethane, 1-[2-(p-hydroxyphenoxy)acetamido]-1-n-octadecanoylaminomethane, 1-[3-(p-hydroxyphenoxy)propanamido]-1-n-octadecanoylaminomethane, 1-[11-(p-hydroxyphenoxy)-undecanamido]-1-n-decanoylaminomethane, 1-[p-(p-hydroxyphenoxy)benzamido]-1-n-octadecanoylaminomethane, 1-[2-(p-hydroxyphenoxy)acetamido]-1-(N'-n-dodecylureido)methane, 1-[2-(p-hydroxyphenoxy)acetamido]-1-(N'-n-octadecylureido)methane, 1-[3-(p-hydroxyphenoxy)propanamido]-1-(N'-n-octadecylureido)methane, 1-[11-(p-hydroxyphenoxy)undecanamido]-1-(N'-n-decylureido)methane, 1-[p-(p-hydroxyphenoxy)benzamido]-1-(N'-n-octadecylureido)-methane, 1-{N'-[2-(p-hydroxyphenoxy)ethyl]ureido}-1-n-octadecanoylaminomethane, 1-{N'-[p-(p-hydroxyphenoxy)phenyl]ureido}-1-n-octadecanoylaminomethane, N-[2-(p-hydroxyphenoxy)ethyl]-N'-n-octadecylmalonamide, N-[p-(p-hydroxyphenoxy)phenyl]-N'-n-octadecylmalonamide, etc.

Finally, specific examples of the compound represented by the formula (3) may include N-n-dodecyl-2-[p-(p-hydroxyphenoxy)phenoxy]acetamide, N-n-octadecyl-2-[p-(p-hydroxyphenoxy)phenoxy]acetamide, N-n-decyl-3-[p-(p-hydroxyphenoxy)phenoxy]propanamide, N-n-octadecyl-3-[p-(p-hydroxyphenoxy)phenoxy]propanamide, N-n-octadecyl-6-[p-(p-hydroxyphenoxy)phenoxy]hexanamide, N-n-decyl-11-[p-(p-hydroxyphenoxy)phenoxy]undecanamide, N-n(p-n-octylphenyl)-6-[p-(p-hydroxyphenoxy)phenoxy]hexanamide, N-n-octadecyl-p-[p-(p-hydroxyphenoxy)phenoxy]benzamide, N-[p-(p-hydroxyphenoxy)phenoxy]methyl-n-dodecanamide, N-[p-(p-hydroxyphenoxy)phenoxy]methyl-n-octadecanamide, N-[2-{p-(p-hydroxyphenoxy)phenoxy}ethyl]-n-octadecanamide, N-[6-{p-(p-hydroxyphenoxy)phenoxy}hexyl]-n-decanamide, N-[p-{p-(p-hydroxyphenoxy)phenoxy}phenyl]-n-octadecanamide, N-[p-(p-hydroxyphenoxy)phenoxy]methyl-3-(n-dodecylthio)propanamide, N-[p-(p-hydroxyphenoxy)phenoxy]methyl-2-(n-octadecylthio)acetamide, N-[2-{p-(p-hydroxyphenoxy)phenoxy}ethyl]-2-(n-octadecyloxy)acetamide, N-[6-{p-(p-hydroxyphenoxy)phenoxy}hexyl-11-(n-octadecyloxy)undecanoamide, N-[p-{p-(p-hydroxyphenoxy)phenoxy}phenyl]-11-(n-octadecyloxy)undecanoamide, N-[2-{p-(p-hydroxyphenoxy)phenoxy}ethyl]-N'-n-tetradecylurea, N-[2-{p-(p-hydroxyphenoxy)phenoxy}ethyl]-N'-n-octadecylurea, N-[2-{p-(3,4-dihydroxphenoxy)phenoxy}ethyl]-N'-n-octadecylurea, N-[6-{p-(p-hydroxyphenoxy)phenoxy}hexyl]-N'-n-decylurea, N-[p-{p-(p-hydroxyphenoxy)phenoxy}phenyl]-N'-n-octadecylurea, N-[10-{p-(p-hydroxyphenoxy)phenoxy}-decyl]-N'-n-decylurea, n-octadecyl N-[2-{p-(p-hydroxyphenoxy)phenoxy}-ethyl]carbamate, n-tetradecyl N-[6-{p-(p-hydroxyphenoxy)phenoxy}hexyl]carbamate, n-dodecyl N-[p-{p-(p-hydroxyphenoxy)phenoxy}phenyl]carbamate, [2-{p-(p-hydroxyphenoxy)phenoxy}ethyl]N-n-octadecylcarbamate, [11-{p-(p-hydroxyphenoxy)phenoxy}undecyl]N-n-decylcarbamate, [p-{p-(p-hydroxyphenoxy)phenoxy}phenyl]N-n-tetradecylcarbamate, N-[3-{p-(p-hydroxyphenoxy)phenoxy}propionyl]-N-n-octadecanoylamine, N-[6-{p-(p-hydroxyphenoxy)phenoxy}hexanoyl]-N-n-octadecanoylamine, N-[3-{p-(p-hydroxyphenoxy)phenoxy}propionyl]-N-(p-n-octylbenzoyl)amine, N-[2-{p-(p-hydroxyphenoxy)phenoxy}aceto]-N'-n-dodecanohydrazide, N-[2-{p-(p-hydroxyphenoxy)phenoxy}aceto]-N'-n-octadecanohydrazide, N-[3-{p-(p-hydroxyphenoxy)phenoxy}propiono]-N'-n-octadecanohydrazide, N-[3-{p-(3,4-dihydroxyphenoxy)phenoxy}propiono]-N'-n-octadecanohydrazide, N-[6-{p-(p-hydroxyphenoxy)phenoxy}hexano]-N'-n-tetradecanohydrazide, N-[6-{p-(p-hydroxyphenoxy)phenoxy}-hexano]-N'-n-octadecanohydrazide, N-[6-{p-(p-hydroxyphenoxy)phenoxy}hexano]-N'-(p-n-octylbenzo)hydrazide, N-[11-{p-(p-hydroxyphenoxy)phenoxy}undecano]-N'-n-decanohydrazide, N-[11-{p-(p-hydroxyphenoxy)phenoxy}undecano]-N'-n-dodecanohydrazide, N-[11-{p-(p-hydroxyphenoxy)phenoxy}undecano]-N'-n-tetradecanohydrazide, N-[11-{p-(p-hydroxyphenoxy)phenoxy}undecano]-N'-n-octadecanohydrazide, N-[11-{p-(p-hydroxyphenoxy)phenoxy}undecano]-N'-(6-phenyl)hexanohydrazide, N-[11-{p-(3,4,5-trihydroxyphenoxy)phenoxy}undecano]-N'-n-octadecano hydrazide, N-[p-{p-(p-hydroxyphenoxy)phenoxy}benzo]-N'-n-octadecanohydrazide, N-[2-{p-(p-hydroxyphenoxy)phenoxy}ethyl]-N'-n-tetradecyloxamide, N-[3-{p-(p-hydroxyphenoxy)phenoxy}propyl]-N'-n-octadecyloxamide, N-[3-{p-(3,4-dihydroxyphenoxy)phenoxy}propyl]-N'-n-octadecyloxamide, N-[11-{p-(p-hydroxyphenoxy)phenoxy}undecyl]-N'-n-decyloxamide, N-[p-{p-(p-hydroxyphenoxy)phenoxy}phenyl]-N'-n-octadecyloxamide, N-[2-{p-(p-hydroxyphenoxy)phenoxy}acetyl]-N'-n-dodecylurea, N-[2-{p-(p-hydroxyphenoxy)phenoxy}acetyl]-N'-n-octadecylurea, N-[3-{p-(p-hydroxyphenoxy)phenoxy}-propionyl]-N'-n-octadecylurea, N-[p-{p-(p-hydroxyphenoxy)phenoxy}benzoyl]-N'-n-octadecylurea, N-[2-{p-(p-hydroxyphenoxy)phenoxy}ethyl]-N'-n-dodecanoylurea, N-[2-{p-(p-hydroxyphenoxy)phenoxy}ethyl]-N'-n-octadecanoylurea, N-[p-{p-(p-hydroxyphenoxy)phenoxy}phenyl]-N'-n-octadecanoylurea, n-octadecyl 3-[3-{p-(p-hydroxyphenoxy)phenoxy}-propionyl]carbazinate, n-decyl 3-[11-{p-(p-hydroxyphenoxy)phenoxy}undecanoyl]carbazinate, 4-[2-{p-(p-hydroxyphenoxy)phenoxy}ethyl]-1-n-tetradecylsemicarbazide, 4-[2-{p-(p-hydroxyphenoxy)phenoxy}ethyl]-1-n-octadecylsemicarbazide, 4-[p-{p-(p-hydroxyphenoxy)phenoxy}phenyl]-1-n-tetradecylsemicarbazide, 1-[2-{p-(p-hydroxyphenoxy)phenoxy}ethyl]-4-n-tetradecylsemicarbazide, 1-[2-{p-(p-hydroxyphenoxy)phenoxy}ethyl]-4-n-octadecylsemicarbazide, 1-[p-{p-(p-hydroxyphenoxy)phenoxy}phenyl]-4-n-tetradecylsemicarbazide, 1-[2-{p-(p-hydroxyphenoxy)phenoxy}acetyl]-4-n-tetradecylsemicarbazide, 1-[3-{p-(p-hydroxyphenoxy)phenoxy}propionyl]-4-n-octadecylsemicarbazide, 1-[11-{p-(p-hydroxyphenoxy)phenoxy}undecanoyl]-4-n-decylsemicarbazide, 1-[p-{p-(p-hydroxyphenoxy)phenoxy}benzoyl]-4-n-octadecylsemicarbazide, 4-[2-{p-(p-hydroxyphenoxy)phenoxy}ethyl]-1-n-tetradecanoylsemicarbazide, 4-[2-{p-(p-hydroxyphenoxy)phenoxy}ethyl]-1-n-octadecanoylsemicarbazide, 4-[p-{p-(p-hydroxyphenoxy)phenoxy}phenyl]-1-n-octadecanoylsemicarbazide, 1-[2-{p-(p-hydroxyphenoxy)phenoxy}acetamido]-1-n-dodecanoylaminomethane, 1-[2-{p-(p-hydroxyphenoxy)phenoxy}acetamido]-1-n-octadecanoylaminomethane, 1-[3-{p-(p-hydroxyphenoxy)phenoxy}propanamido]-1-n-octadecanoylaminomethane, 1-[11-{p-(p-hydroxyphenoxy)phenoxy}undecanamido]-1-n-decanoylaminomethane, 1-[p-{p-(p-hydroxyphenoxy)phenoxy}benzamido]-1-n-octadecanoylaminomethane, 1-[2-{p-(p-hydroxyphenoxy)phenoxy}acetamido]-1-(N'-n-dodecylureido)methane, 1-[2-{p-(p-hydroxyphenoxy)phenoxy}acetamido]-1-(N'-n-octadecylureido)methane, 1-[3-{p-(p-hydroxyphenoxy)phenoxy}propanamido]-1-(N'-n-octadecylureido)methane, 1-[11-{p-(p-hydroxyphenoxy)phenoxy}-undecanamido]-1-(N'-n-decylureido)methane, 1-[p-{p-(p-hydroxyphenoxy)phenoxy}benzamido]-1-(N'-n-octadecylureido)methane, 1-{N'-[2-{p-(p-hydroxyphenoxy)phenoxy}-ethyl]ureido}-1-n-octadecanoylaminomethane, 1-{N'-[p-{p-(p-hydroxyphenoxy)phenoxy}phenyl]ureido}-1-n-octadecanoylaminomethane, N-[2-{p-(p-hydroxyphenoxy)phenoxy}ethyl]-N'-n-octadecylmalonamide, N-[p-{p-(p-hydroxyphenoxy)phenoxy}phenyl]-N'-n-octadecylmalonamide, etc.

An amount of the electron-accepting compound to be used based on the colorless or pale color electron-donative dye precursor in the reversible heat-sensitive color forming composition of the present invention is 5 to 5000% by weight, preferably 10 to 3000% by weight.

As the electro-donative dye precursor which is colorless or a pale color to be used in the present invention, it is represented by those generally used in a pressure-sensitive recording paper or a heat-sensitive recording paper, but it is not particularly limited by these materials. Specific examples may include those as mentioned below but the present invention is not limited by these.

(1) Triarylmethane Type Compounds 3,3-Bis(p-dimethylaminophenyl)-6-dimethylaminophthalide (Crystal violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3-(4-diethylamino-2-ethoxyphenyl)-3-(1-ethyl-2-methylindol-3-yl)phthalide, 3-(4-diethylamino-2-ethoxyphenyl)-3-(1-ethyl-2-methylindol-3-yl)-4-azaphthalide, 3-(4-diethylamino-2-ethoxyphenyl)-3-(1-ethyl-2-methylindol-3-yl)-4,7-diazaphthalide, 3-(4-diethylamino-2-ethoxyphenyl)-3-(1-ethyl-2-methylindol-3-yl)-7-azaphthalide, 3-[(4-ethyl-4-phenyl)amino-2-ethoxyphenyl]-3-(1-ethyl-2-methylindol-3-yl-4-azaphthalide, 3-(4-diethylamino-2-n-hexyloxyphenyl)-3-(1-ethyl-2-methylindol-3-yl)-4-azaphthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, 3,3-bis(p-dimethylaminophenyl)-4-azaphthalide, etc.

(2) Diphenylmethane Type Compounds 4,4'-Bis(dimethylaminophenyl)benzhydrylbenzyl ether, N-chlorophenyl leucoauramin, N-2,4,5-trichlorophenyl leucoauramin, etc.

(3) Xanthene Type Compounds

Rhodamin B anilinolactam, Rhodamin B-p-chloroanilinolactam, 3-diethylamino-7-dibenzylaminofluoran, 3-diethylamino-7-octylaminofluoran, 3-diethylamino-7-phenylfluoran, 3-diethylamino-7-phenoxyfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylfluoran, 3-diethylamino-7-(4-nitroanilino)fluoran, 3-diethylamino-7-(2-chloroanilino)fluoran, 3-dibutylamino-7-(2-chloroanilino)fluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tetrahydrofuryl)amino-6-methyl-7-anilinofluoran, etc.

(4) Thiazine Type Compounds

Benzoylleucomethylene blue, p-nitrobenzoylleucomethylene blue, etc.

(5) Spiro Type Compounds

3-Methylspirodinaphthopyran, 3-ethylspirodinaphthopyran, 3,3'-dichlorospirodinaphthopyran, 3-benzylspirodinaphthopyran, 3-methylnaphtho-(3-methoxybenzo)spiropyran, 3-propylspirobenzopyran, etc.

The above-mentioned colorless or slightly colored electron-donative dye precursors may be used each alone or in combination of two or more.

As the method for preparing the reversible two-color heat-sensitive recording material of the present invention, there may be mentioned, for example, a method in which a composition containing the electron-donative dye precursors and the reversible color developing agent which is an electron-accepting compound as main components is prepared, and the composition is coated in a suitable form such a coating solution, etc., on a support to form a reversible heat-sensitive recording layer.

As the method for preparing a coating solution of the reversible two-color heat-sensitive recording material according to the present invention, there may be mentioned a method in which the respective compounds are each dissolved in a solvent or dispersed in a dispersant and they are mixed, a method in which the respective compounds are mixed and then the mixture is dissolved in a solvent or dispersed in a dispersant, a method in which the respective compounds are dissolved by heating, homogeneously mixed, and after cooling, the mixture is dissolved in a solvent or dispersed in a dispersant, and the like, but it is not particularly limited. A dispersing aid may be added at the time of dispersion. As the dispersing aid when water is used as a dispersant, for example, a water-soluble polymer such as polyvinyl alcohol, etc., or various kinds of surfactants can be utilized. In the case of an aqueous dispersion, a water-soluble organic solvent such as ethanol, etc., may be mixed. In addition, when an organic solvent represented by a hydrocarbon is used as a dispersant, lecithin or a phosphate, etc., may be used as a dispersing aid.

Also, for the purpose of improving strength of the reversible heat-sensitive recording layer, or the like, a binder may be added to the reversible heat-sensitive recording layer. Examples of the binder may include water-soluble polymers such as starches, hydroxyethyl cellulose, methyl cellulose, carboxymethyl cellulose, gelatin, casein, polyvinyl alcohol, modified polyvinyl alcohol, sodium polyacrylate, acrylamide/acrylate copolymer, acrylamide/acrylate/methacrylic acid terpolymer, an alkali salt of a styrene/maleic anhydride copolymer, an alkali salt of an ethylene/maleic anhydride copolymer, etc.; latexes such as polyvinyl chloride, polyurethane, polyacrylate, styrene/butadiene copolymer, acrylonitrile/butadiene copolymer, methyl acrylate/butadiene copolymer, ethylene/vinyl acetate copolymer, ethylene/vinyl chloride copolymer, polyvinyl chloride, ethylene/vinylidene chloride copolymer, polyvinylidene chloride, etc. A role of these binders is to maintain the state in which the respective materials of the composition are uniformly dispersed without causing localization of the materials when heat for printing and erasing an image or letter is applied thereto. Accordingly, it is preferred to use a resin having high thermal resistance as a binder resin. In recent years, a high value-added reversible heat-sensitive recording material has frequently been used and accompanied thereby, a highly durable product having high thermal resistance, high water resistance, and further high adhesiveness has been required. For responding to such a demand, a curable resin is particularly preferred.

Examples of the curable resin may include, for example, a thermosetting resin, an electron beam curable resin, an ultraviolet ray curable resin, etc. As the thermosetting resin, there may be mentioned, for example, a resin in which a hydroxyl group or a carboxyl group is reacted with a crosslinking agent and cured, such as a phenoxy resin, a polyvinyl butyral resin, a cellulose acetate propionate resin, etc. As the crosslinking agent at this time, there may be mentioned, for example an isocyanate compound, an amine compound, a phenol compound, an epoxy compound, etc.

As the monomer to be used for an electron beam and/or UV-ray curable resin, there may be mentioned a monofunctional monomer, a di-functional monomer, a polyfunctional monomer represented by an acrylic type monomer. It is particularly preferred that a photopolymerization initiator and/or a photopolymerization promoter is used when an ultraviolet ray crosslinking is carried out.

Also, as a decolorization controller for controlling a decolorization temperature of the reversible heat-sensitive composition, compounds disclosed in, for example, Japanese Patent Application Kokai Nos. 9-48175, 9-300820 and 10-44607 may be contained in the reversible heat-sensitive recording layer. Those having a melting point of 60° C. to 200° C. are preferred, and particularly those having a melting point of 80° C. to 180° C. are preferred.

As the specific examples of the decolorization controller to be preferably used in the present invention, the following compounds may be mentioned, but the present invention is not limited by these.

There may be mentioned N-(3-diethylaminopropyl)-11-decylthioundecanamide, 11-dodecylthioundecyl N-(3-diethylaminopropyl)carbamate, 6-diethylaminohexyl N-(2-octadecylthioethyl)carbamate, N-6-dimethylaminocaprono-N'-3-dodecylthiopropionohydrazide, 2-(1-pyrrolidinyl)ethyl N-octadecylcarbamate, N-3-pyrrolidinylpropiono-N'-octadecanohydrazide, N-5-1H-tetrazolyl-N'-10-decylthiodecylurea, N-tetradecylsuccinimide, N-hexadecylsuccinimide, octadecylsuccinimide, N-docosylsuccinimide, N-dodecylglutarimide, N-(4-heptylphenyl)glutarimide, N-tetradecylglutarimide, N-hexadecylglutarimide, N-octadecylglutarimide, octadecanohydrazide, docosanohydrazide, 3-(docosylthio) propionohydrazide, 11-(octadecylthio)undecanohydrazide, 1-methyl-2-tetradecylpyrazolium tosylate, 1-methyl-3-octadecylimidazolium tosylate, 3-octadecylthiazolium bromide, 1-octadecylpyridinium tosylate, 1-hexadecylpyridinium tosylate, 1-hexadecylpyridinium chloride, etc.

Moreover, for the purpose of controlling decolorization similarly, a sensitizer which has been used in the general heat-sensitive recording paper may be used. As such a sensitizer, there may be mentioned waxes such as n-hydroxymethyl stearamide, behenamide, stearamide, palmitamide, etc., a naphthol derivative such as 2-benzyloxynaphthalene, etc., a biphenyl derivative such as p-benzylbiphenyl, 4-allyloxybiphenyl, etc., a polyether compound such as 1,2-bis(3-methylphenoxy)ethane, 2,2'-bis(4-methoxyphenoxy)diethyl ether, bis(4-methoxyphenyl) ether, etc., carbonic acid or oxalic acid diester derivative such as diphenyl carbonate, dibenzyl oxalate, bis(p-methylbenzyl) oxalate, etc., and they can be used in combination of two or more kinds.

In order to make the difference in thermal conductivities of two kinds of the reversible heat-sensitive recording layers according to the present invention large, it can be accomplished by providing an intermediate layer or at least one of the reversible heat-sensitive composition is encapsulated in microcapsules. As the intermediate layer, the above-mentioned resin binder can be used, and also, a heat resistant resin film may be used by adhering it onto the recording layer. Microcapsulation can be carried out by the conventionally known method such as a coacervation method, an interfacial polymerization method, an in situ method, a spray dry method, etc.

As the support to be used for the reversible heat-sensitive recording layer of the present invention, there may be optionally used paper, coated paper, various nonwoven fabrics, woven fabrics, synthetic resin films such as polyethylene terephthalate or polypropylene, laminated paper of synthetic resins such as polyethylene, polypropylene, etc., synthetic papers, metallic foils, glasses and composite sheets comprising the combination of these materials depending on the purposes. The present invention is not limited by these, and these materials may be either of opaque, semi-transparent or transparent. Also, in order to make the background color white or any other specific color, a white pigment, a colored dye or pigment, or foam may be contained in the support or the surface thereof. Particularly when an aqueous coating is carried out on a support such as a film, etc., and when the surface of the support has low hydrophilicity and it is difficult to coat a composition for the reversible heat-sensitive recording layer, the surface of the support may be subjected to corona discharge treatment to make the surface hydrophilic or to coat a water-soluble polymer which is the same as a binder on the surface of the support to make easy adhesion.

In the layer structure of the reversible two-color heat-sensitive recording layer of the present invention, it may comprise a reversible heat-sensitive recording layer alone or may comprise a reversible heat-sensitive recording sheet adhered to a support. If necessary, a protective layer may be provided on the reversible heat-sensitive recording layer, or an intermediate layer containing at least one of water-soluble polymer, white colored or colored dyes or pigments, or hollow particles maybe provided between the reversible heat-sensitive recording layer and the support. In this case, the protective layer and/or the intermediate layer may be constituted by a plural number of layers of two layers or three or more layers. The reversible heat-sensitive recording layer may be constituted by a plural number of layers of two or more by adding the respective components to the respective layers or by changing the compositional ratio in the respective layers. Moreover, a material which is capable of recording an information electrically, optically or magnetically may be contained in the reversible heat-recording layer and/or in the other layer(s) and/or at the surface opposite to the surface on which the reversible heat-sensitive recording layer is provided. Also, it is possible to provide a back coating layer for the purpose of preventing from blocking, curl and charging at the surface opposite to the surface on which the reversible heat-sensitive recording layer is provided.

A method for forming the reversible two-colored heat-sensitive recording material of the present invention by laminating the respective layers on the support is not particularly limited, and it can be formed by the conventionally known method. For example, it may be used various kinds of coating apparatuses such as air knife coater, blade coater, bar coater, curtain coater, etc., various kinds of printing machines by the system of lithographic, relief, intaglio, flexographic, gravure, screen or hot melt, etc. Further, in addition to the usual drying procedure, respective layers can be retained by ultraviolet (UV) irradiation or electron-beam (EB) irradiation.

The reversible heat-sensitive recording layer can be obtained by a method in which the respective dispersions obtained by finely pulverizing the respective components are mixed and coated on the support followed by drying; a method in which the respective solutions obtained by dissolving the respective components in a solvent are mixed and coated on the support followed by drying, etc. The drying conditions vary depending on the dispersant or solvent such as water, etc. In addition, there is a method in which the respective components are mixed and meltable components are melted, and the melted materials are subjected to hot coating.

Also, in the reversible heat-sensitive recording layer and/or the protective layer and/or the intermediate layer, there maybe added pigments or others such as diatomaceous earth, talc, kaolin, backed kaolin, calcium carbonate, magnesium carbonate, titanium oxide, zinc oxide, silicon dioxide, aluminum hydroxide, urea-formalin resin, etc., and a higher fatty acid metal salt such as zinc stearate, calcium stearate, etc., or waxes such as paraffin, oxidized paraffin, polyethylene, polyethylene oxide, stearic amide, castor wax, etc. to prevent from wearing head or sticking; a dispersing aid such as sodium dioctylsulfosuccinate, etc.; and a surfactant, fluorescent dye, ultraviolet rays absorber, etc.

Next, a method of forming a color and erasing a color of the reversible two-color heat-sensitive recording material of the present invention is described. Among the reversible heat-sensitive color-forming compositions of the present invention, with regard to the composition having a slow crystallization rate, it forms a color when rapid cooling occurs subsequent to heating. Moreover, it is possible to effect printing under heating at heating conditions at which the composition having a rapid crystallization rate is not color-formed. As the method for obtaining such conditions, there are, for example, printing under heating by using a thermal head, a laser beam light, etc., while heating the reversible two-color heat-sensitive recording material of the present invention using thermal head, hot roll, hot stamping, high frequency heating, hot air, electrical heater, radiant heat from a light source such as tungsten lamp, halogen lamp, etc. On the other hand, for effecting color formation of the composition having a rapid crystallization rate, it is sufficient to cause rapid cooling subsequent to heating, and it is possible by heating, for example, a thermal head, a laser beam, etc. At this time, by applying energy with such a degree at which the above-mentioned composition having a slow crystallization rate is not color-formed whereby the respective single colors can be obtained. Also, they are decolorized when it is slowly cooled after heating similarly as in the conventional reversible heat-sensitive recording material, and it can be carried out by using, for example, thermal head, hot roll, hot stamping, high frequency heating, hot air, electrical heater, radiant heat from a light source such as tungsten lamp or halogen lamp, or the like.

Figure 2:
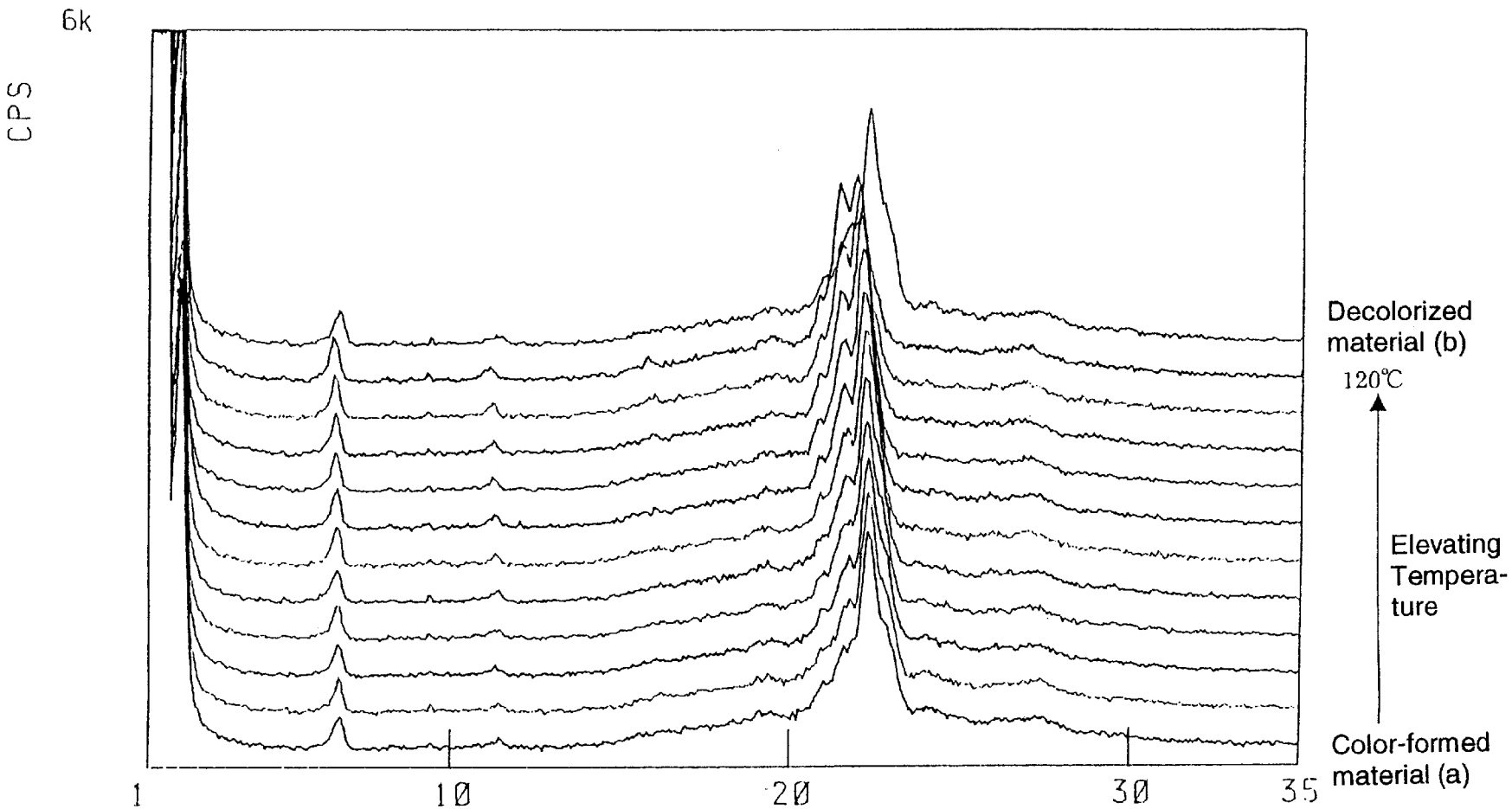
FIG. 2 is an X-ray diffraction spectrum of a color forming composition (R composition) having a rapid crystallization rate to be used in the present invention.

The principle of the image forming and erasing of the present invention is not particular about the following, but it can be considered as follows. That is, the reversible two-color heat-sensitive recording material of the present invention is characterized in that crystallization rates of at least two kinds of reversible color developing agents are different from each other when the color-formation state of the reversible color-formation composition changes to the decolorization state. A reversible color-formation composition (S composition) having a slow crystallization rate to be used in the present invention still forms a colored material stably even when it is cooled to room temperature by allowing to stand if it is heated and melted at a temperature not less than the melting point of the reversible color developing agent to be contained therein. A measured result of an X-ray diffraction (Cu-Kα) at this time is shown in (a) of FIG. 1. This colored material does not show clear diffraction peak so that the material can be considered to be an amorphous structured material (A structure material). Then, when the colored material is heated at a decolorization temperature region existing at not more than the melting point of the reversible color developing agent, and then, cooled to room temperature by allowing to stand, a decolorization material is formed. At this time, as can be clearly seen from (b) of FIG. 1, the decolorization material has a diffraction peak of crystal so that the material can be considered to exist as a crystal structured material (C structure material). On the other hand, a reversible color-formation composition (R composition) having a rapid crystallization rate to be preferably used in the present invention does not form a colored material even when it is heated and melted at a temperature not less than the melting point of the reversible color developing agent, and then, cooled to room temperature by allowing to stand. To obtain the colored material of the R composition, it is necessary to make the cooling rate of the above-mentioned S composition rapid. An X-ray diffraction of the colored material of the R composition is shown in (a) of FIG. 2. This colored material is clearly different from the S composition and it can be admitted to be a structure having a diffraction peak. Since the colored material is clearly different from the C structure material of the decolorization material of (b) in FIG. 2, it can be considered to be a lamella structured material (L structure material). A composition the colored material of which takes an L structure material does not generally show an exothermic peak in the course of raising the temperature of the colored material when it is measured by a differential scanning calorimetry (DSC). That is, it is suggested that whereas the L structure material is a colored material, it can be changed to a C structure material in an instant by receiving a little heat energy. Thus, by using such compositions in combination, it can be realized to form a color of one of the compositions, and also, to erase colors of the both compositions at the same temperature.

EXAMPLES

In the following, the present invention is explained in more detail by referring to Examples. In Examples, all the parts mean "parts by weight".

Example 1

On a hot plate at 180° C., 4 parts of N-[11-(p-hydroxyphenoxy)undecano]-N'-decanohydrazide which is a reversible color developing agent and 1 part of 3-diethylaminophenyl-7-phenoxyfluoran which is an electron donating dye precursor were melted by mixing to obtain a color formed state. From this color formed state, the mixture was cooled to 25° C. by changing a cooling rate to obtain samples. X-ray diffractions (Cu-Kα) of the respective samples were measured and the cooling rate in which the above-mentioned crystal structure material was confirmed was made the crystallization rate of the composition. As a result, the crystallization rate of the composition was 5° C./sec.

Example 2

A crystallization rate of the composition comprising N-[3-(p-hydroxyphenyl)propiono]-N'-octadecanohydrazide and 3-(4-diethylamino-2-ethoxyphenyl)-3-(1-ethyl-2-methyl-indol-3-yl)phthalide was measured in the same manner as in Example 1, and it was 180° C./sec.

Example 3

When differential scanning calorimetry of the mixture at the color formed state used in Example 2 was measured, no exothermic peak was shown during the temperature raising step.

From the above-mentioned results, Example 1 which shows a slow crystallization rate was called to an S composition and that of Example 2 having a rapid crystallization rate was called to an R composition, and the reversible heat-sensitive coating solutions were prepared as mentioned below.

Example 4

(A) Preparation of S Composition-containing Reversible Heat-sensitive Coating Solution 30 parts of 3-diethylaminophenyl-7-phenoxyfluorane and 100 parts of N-[11-(p-hydroxyphenoxy)undecano]-N'-decanohydrazide were pulverized with 9100 parts of a tetrahydrofuran (THF) solution containing 8% polyvinyl acetal (available from Sekisui Kagaku Kogyo K. K., BL-1, acetal degree: 63 mol %) by a paint conditioner to obtain a reversible heat-sensitive dispersion (Solution A).

(B) Preparation of R Composition-containing Reversible Heat-sensitive Coating Solution 30 parts of 3-(4-diethylamino-2-ethoxyphenyl)-3-(1-ethyl-2-methylindol-3-yl)phthalide, 100 parts of N-[3-(p-hydroxyphenyl)propiono]-N'-octadecanohydrazide and 5 parts of N-octadecylsuccinimide were pulverized with 9100 parts of a tetrahydrofuran (THF) solution containing 8% polyvinyl acetal (available from Sekisui Kagaku Kogyo K. K., BL-1, acetal degree: 63 mol %) by a paint conditioner to obtain a reversible heat-sensitive dispersion (Solution B).

(C) Coating of Reversible Heat-sensitive Recording Layer (Solution A)

To Solution A prepared in (A) was added 29 parts of Colonate L (available from Nippon Polyurethane K. K.) and then the mixture was coated on a polyethylene terephthalate (PET) sheet so that a coated amount of the solid component became 6.0 g/m$^2$. The coated layer was dried at 60° C. for 24 hours and treated with a super calendar to obtain a reversible heat-sensitive recording layer.

(D) Coating of Intermediate Layer

With 9100 parts of a tetrahydrofuran (THF) solution containing 8% of polyvinyl acetal (available from Sekisui Kagaku Kogyo, BL-1, acetal degree: 63%) was mixed 29 parts of Colonate L, and the mixture was coated on the recording layer prepared in (C) by coating so that a coated amount of the solid component became 10.0 g/m$^2$. The coated layer was dried at 60° C. for 24 hours and treated with a super calendar to obtain an intermediate layer.

(E) Coating of Reversible Heat-sensitive Layer (Solution B)

Onto the coated sheet prepared in (D), after adding 29 parts of Colonate L to Solution B prepared in (B) and then the mixture was coated on the polyethylene terephthalate (PET) sheet so that a coated amount of the solid component became 4.5 g/m$^2$. The coated layer was dried at 60° C. for 24 hours and treated with a super calendar to obtain a reversible two-color heat-sensitive recording material.

Comparative Example 1

In the same manner as in Example 1, crystallization rates of the composition comprising hexadecylphosphonic acid and 1,2-benzo-6-(N-ethyl-N-iso-amylamino)fluoran, and the composition comprising dihexadecyl phosphate and 3-diethylamino-6-methyl-7-anilinofluoran were measured. As a result, both compositions were extremely low as 0.5° C./sec. so that no difference could be admitted.

Comparative Example 2

In Example 4, 3-diethylaminophenyl-7-phenoxyfluoran of Solution A was changed to 1,2-benzo-6-(N-ethyl-N-iso-amylamino)fluorine and N-[11-(p-hydroxyphenoxy) undecano]-N'-decanohydrazide to hexadecylphosphonic acid. A reversible two-color heat-sensitive recording material was prepared in the same manner as in Example 4 except that 3-(4-diethylamino-2-ethoxyphenyl)-3-(1-ethyl-2-methylindol-3-yl)-phthalide of Solution B was changed to 3-diethylamino-6-methyl-7-anilinofluorane, and N-[3-(p-hydroxyphenyl)propiono]-N'-octadecanohydrazide to dihexadecyl phosphate.

Test 1 (Color Forming Property of Composition S)

The reversible two-color heat-sensitive recording materials obtained in Example 4 and Comparative example 2 were printed by using CARD READER WRITER KUR-3071 manufactured by Kyushu Matsushita Denki K. K., with an energy corresponding to a printing energy of 0.826 mj/dots while driving an erasion bar at 130° C. Then, in Example of the present invention, a clear red color-formed image alone was obtained. To the contrary, in the comparative example, the formed red-color image was completely erased and the formed black-color image was also disappeared to the degree which could be slightly admitted with eyes.

Utilizability in Industry

From the above-mentioned test results, it can be understood that the present invention can provide a reversible two-color heat-sensitive color-forming recording material having a stable color formation and discoloration contrast, having an image stability which is practically no problem in everyday life, and further capable of effecting high speed letter-printing and erasable, and a recording method of an image.

What is claimed is:

1. A reversible two-color heat-sensitive recording material which uses an electron-donative dye precursor which is usually colorless or a pale color and an electron-accepting compound, in reversible heat-sensitive color-forming composition layers which are capable of forming a color-formation state and decolorization state relatively due to difference in heating temperature and at least one cooling rate after heating is formed on a support, wherein said reversible heat-sensitive color-forming composition layers comprise at least two kinds of composition layers having different color tones to be formed and said compositions are each present separately and in an independent state, and crystallization rates of said electron-accepting compounds at the time of changing from the color-formation state to the decolorization state are different from each other.

2. The reversible two-color heat-sensitive recording material according to claim 1, wherein at least one of the mixtures in the color-formation state obtained by melting said reversible heat-sensitive color-forming composition layers under heating and rapidly cooling does not show an exothermic peak during elevation of the temperature measured by differential scanning calorimetry analysis or differential thermal analysis.

3. The reversible two-color heat-sensitive recording material according to claim 1, wherein at least one of the mixtures in the color-formation state obtained by melting said reversible heat-sensitive color-forming composition layers under heating and rapidly cooling does not form a color-formation state when said composition is cooled from the heated state at the melting point of the electron-accepting compound in said composition layers or more to room temperature by allowing to stand.

4. The reversible two-color heat-sensitive recording material according to claim 1, wherein at least one of the electron-accepting compounds is a compound represented by the following formula (1):

(1)

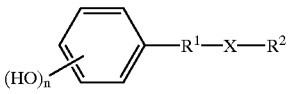

wherein n is an integer of 1 to 3, $R^1$ represents a divalent hydrocarbon group having 1 to 18 carbon atoms, X represents a divalent group having at least one —CONH— bond, and $R^2$ represents a hydrocarbon group having 1 to 24 carbon atoms.

5. The reversible two-color heat-sensitive recording material according to claim 1, wherein at least one of the electron-accepting compounds is a compound represented by the following formula (2):

(2)

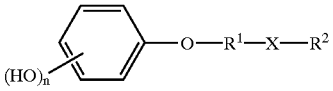

wherein n is an integer of 1 to 3, $R^1$ represents a divalent hydrocarbon group having 1 to 18 carbon atoms, X represents a divalent group having at least one —CONH— bond, and $R^2$ represents a hydrocarbon group having 1 to 24 carbon atoms.

6. The reversible two-color heat-sensitive recording material according to claim 1, wherein at least one of the electron-accepting compounds is a compound represented by the following formula (3):

(3)

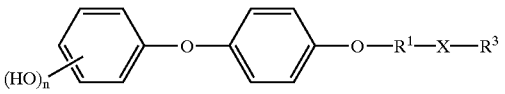

wherein n is an integer of 1 to 3, $R^1$ represents a divalent hydrocarbon group having 1 to 18 carbon atoms, X represents a divalent group having at least one —CONH— bond, and $R^3$ represents a hydrocarbon group having 1 to 24 carbon atoms which may have an oxygen atom or a sulfur atom.

7. The reversible two-color heat-sensitive recording material according to claim 1, wherein the electron-receiving compound comprises a combination of two compounds represented by the formula (1) and the formula (2).

8. The reversible two-color heat-sensitive recording material according to claim 1, wherein the electron-receiving compound comprises a combination of two compounds represented by the formula (1) and the formula (3).

9. The reversible two-color heat-sensitive recording material according to claim 1, wherein in the reversible heat-sensitive color-formation compositions, at least one of which contains a decolorization controller which controls a crystallization rate for forming a decolorization state by cooling after heating.

10. The reversible two-color heat-sensitive recording material according to claim 9, wherein at least one selected from an amine compound, an ammonium compound, an imide compound, a phosphonium compound, a carboxylic acid hydrazide compound and a sulfonium compound each having a hydrocarbon group having 6 or more carbon atom is used as the decolorization controller.

11. The reversible two-color heat-sensitive recording material according to claim 1, wherein two kinds of the reversible heat-sensitive color-forming composition layers formed on the same side of the support are separated by an intermediate layer.

12. The reversible two-color heat-sensitive recording material according to claim 1, wherein two kinds of the reversible heat-sensitive color-forming composition layers are present at both surfaces of a semitransparent or transparent sheet in a separated or independent state.

13. A reversible two-color heat-sensitive recording material which comprises the reversible two-color heat-sensitive recording material according to claim 12 being adhered to a support.

14. The reversible two-color heat-sensitive recording material according to claim 1, wherein at least one of the reversible heat-sensitive color-forming compositions is encapsulated in a microcapsule each separately, and a color-formation temperature is controlled by a wall of said microcapsule.

15. A reversible two-color heat-sensitive recording method which comprises effecting a first printing of the reversible two-color heat-sensitive recording material in which a reversible heat-sensitive color-forming composition layer is provided on a support at the state of heating the material at a temperature capable of obtaining a cooling rate at which a composition layer having a higher color-formation temperature forms a color-formation state and a composition having a lower color-formation temperature can form a decolorization state, 25 effecting a second printing at the state of a temperature at which said composition having a higher color-formation temperature does not form the color-formation state and said composition layer having a lower color-formation temperature can form a color-formation state, and effecting decolorization at a temperature capable of obtaining a cooling rate at which all of said compositions in the color-formation states can form decolorization states.

16. A reversible two-color heat-sensitive recording material comprising a support and at least two reversible heat-sensitive recording layers having different color tone formed on the same side of the support, wherein the respective reversible heat-sensitive recording layers contain a reversible heat-sensitive color-forming composition comprising an electron-donative dye precursor which is usually colorless or a pale color and an electron-accepting compound which as a crystallization rate different from that contained in other layers, which are capable of forming a color-formed state and decolorization state due to difference in at least one of a heating temperature and a cooling rate after heating.

* * * * *